US012753603B2

(12) United States Patent
Gwak

(10) Patent No.: US 12,753,603 B2
(45) Date of Patent: Oct. 6, 2026

(54) TRANSVERSE-TYPE BUILDING EXTERIOR BLOCK AND METHOD FOR CONSTRUCTING THE SAME

(71) Applicant: KWANG STEEL CO., LTD., Cheongju-si (KR)

(72) Inventor: In Hak Gwak, Daejeon (KR)

(73) Assignee: KWANG STEEL CO., LTD., Cheongju-si (KR)

( * ) Notice: Subject to any disclaimer, the term of this patent is extended or adjusted under 35 U.S.C. 154(b) by 0 days.

(21) Appl. No.: 18/851,591

(22) PCT Filed: Apr. 30, 2024

(86) PCT No.: PCT/KR2024/005835
§ 371 (c)(1),
(2) Date: Sep. 26, 2024

(87) PCT Pub. No.: WO2025/143381
PCT Pub. Date: Jul. 3, 2025

(65) Prior Publication Data

US 2026/0002357 A1 Jan. 1, 2026

(30) Foreign Application Priority Data

Dec. 28, 2023 (KR) ..... 10-2023-0195783

(51) Int. Cl.
*E04B 2/96* (2006.01)

(52) U.S. Cl.
CPC ..... *E04B 2/96* (2013.01)

(58) Field of Classification Search
CPC ... E04B 2/96; E04B 2/88; E04B 2/965; E04B 2/885
USPC ..... 52/235, 236.7
See application file for complete search history.

(56) References Cited

U.S. PATENT DOCUMENTS

| | | | | |
|---|---|---|---|---|
| 5,313,752 | A | 5/1994 | Hatzinikolas | |
| 5,642,594 | A | 7/1997 | Sucre F | |
| 11,377,847 | B2 * | 7/2022 | Naim Ibrahim | E06B 3/5409 |
| 2021/0372133 | A1 | 12/2021 | Hale et al. | |
| 2021/0404181 | A1 * | 12/2021 | Naim Ibrahim | E04B 1/68 |

FOREIGN PATENT DOCUMENTS

| | | | | |
|---|---|---|---|---|
| CN | 111749381 | A * | 10/2020 | E04B 2/965 |
| CN | 112144721 | A | 12/2020 | |
| CN | 116065739 | A * | 5/2023 | E04B 2/96 |

(Continued)

OTHER PUBLICATIONS

Korean Office Action in corresponding Korean Application No. 10-2023-0195783, dated Jul. 25, 2024 (10 pages).

(Continued)

*Primary Examiner* — Patrick J Maestri
(74) *Attorney, Agent, or Firm* — Bookoff McAndrews, PLLC

(57) ABSTRACT

The present disclosure relates to a transverse-type building exterior block and a method for constructing the same, wherein components are pre-manufactured in a factory for easy transport, delivered to a construction site of a main building, and manufactured into a large-area exterior block, thereby reducing or eliminating the need for extensive equipment, manpower, and storage yards, and facilitating rapid construction.

13 Claims, 10 Drawing Sheets

(56) References Cited

FOREIGN PATENT DOCUMENTS

| | | | | | |
|---|---|---|---|---|---|
| CN | 117605207 | A | * | 2/2024 | ..... E04B 2/96 |
| CN | 119308456 | A | * | 1/2025 | ..... E04C 2/08 |
| CZ | 26013 | U1 | | 10/2013 | |
| EP | 4520891 | A1 | * | 3/2025 | ..... E04B 2/96 |
| FI | 95957 | B | | 12/1995 | |
| JP | 6979232 | B | | 12/2021 | |
| KR | 10-2002-0064059 | A | | 8/2002 | |
| KR | 20-0324353 | Y1 | | 8/2003 | |
| KR | 10-2014-0142109 | A | | 12/2014 | |
| KR | 10-2021-0101856 | A | | 8/2021 | |
| KR | 10-2021-0157037 | | | 12/2021 | |
| RU | 40353 | U1 | | 9/2004 | |
| RU | 2516162 | C2 | | 5/2014 | |
| RU | 2553695 | C1 | | 6/2015 | |
| RU | 2641140 | C1 | | 1/2018 | |

OTHER PUBLICATIONS

International Search Report issued in International Application No. PCT/KR2024/005835, issued Sep. 24, 2024 (3 pages).
Russian Office Action in corresponding Russian patent application No. 2024128615, dated Feb. 28, 2025 (8 pages).

* cited by examiner

TRANSVERSE-TYPE BUILDING EXTERIOR BLOCK AND METHOD FOR CONSTRUCTING THE SAME

CROSS-REFERENCE TO RELATED APPLICATION(S)

This is a National Stage Application under 35 U.S.C. § 371 of International Application No. PCT/KR2024/005835, filed Apr. 30, 2024, which claims priority to Korean Patent Application No. 10-2023-0195783, filed on Dec. 28, 2023 each of which is incorporated herein by reference in their entireties.

TECHNICAL FIELD

The present disclosure relates to a transverse-type building exterior block and a method for constructing the same, and more specifically, to a transverse-type building exterior block and a method for constructing the same, which allows large-area exterior block panels to be constructed at once by manufacturing multiple panels into a single exterior block in a high-tech construction method.

BACKGROUND ART

Building exterior panels are used in various types of buildings such as power plants, factories, commercial buildings, and houses. Representative building exterior panels such as sandwich panels, metal panels, and aluminum sheet panels are lightweight materials, which can be constructed using a dry construction method and are widely used due to the trend of increasing building size and height. Such exterior panels also have advantages in terms of economy, insulation, and shortening of the construction period compared to other materials.

Recently, a block construction method has been used as a high-tech construction method. The block construction method is a method of creating multiple exterior panels into a single block to construct a large area at once.

This method improves economy and shortens the construction period, but requires many essential elements such as manpower for transportation, assembly, and installation of the enlarged block, securing storage and installation areas for materials, and assembly production space, with transportation and storage space being especially essential.

In addition, the transportation of blocks is very difficult due to size restrictions, requiring many processes for constructing blocks completed at the storage yard, and it is also very difficult to secure preparation and storage spaces for manufacturing these blocks.

For reference, the existing block size is too large to be transported by vehicle, so transportation to the site by vehicle is not possible during the day and is only possible at night through consultation with the local government.

DISCLOSURE

Technical Problem

The present disclosure relates to a transverse-type building exterior block and a method for constructing the same, and aims to provide a transverse-type building exterior block and a method for constructing the same, wherein components are pre-manufactured in a factory for easy transport, delivered to a construction site of a main building, and manufactured into a large-area exterior block, thereby reducing or eliminating the need for extensive equipment, manpower, and storage yards, and facilitating rapid construction.

Technical Solution

A transverse-type building exterior block of the present disclosure includes: a base unit configured as an assembly of a plurality of vertical frames arranged side by side between an upper horizontal frame and a lower horizontal frame, wherein the base unit has a fixing bracket in the shape of '⊓' fixed to the upper horizontal frame 11, through which vertical bolts penetrate at an interval; a semi-unit formed by arranging the base units in a vertical direction and coupling and fixing the arranged base units to one another; a main unit formed by arranging the semi-units in a horizontal direction and coupling and fixing the semi-unis to one another; and an exterior panel covered and secured to one surface of the main unit.

The base unit may include: an upper horizontal frame; a plurality of vertical frames arranged at intervals along a longitudinal direction of the upper horizontal frame and coupled and fixed thereto; a lower horizontal frame disposed at lower ends of the vertical frames and coupled and fixed thereto; a fixing bracket in the shape of '⊓' provided on one side of the upper horizontal frame in a direction perpendicular to the vertical frames and placed on a support bracket provided in the shape of '⊢' provided on an exterior wall frame of the main building on site; a pair of adjustment bolts vertically penetrating from an upper surface of the fixing bracket to a lower surface of the exterior wall frame to be secured and adjust a height by nut tightening; and a height adjustment bolt vertically penetrating and fixed to the lower horizontal frame at midpoints on both sides of the center along the entire length of the lower horizontal frames.

The upper horizontal frame may be a square pipe or C-beam steel which is a single frame that determines a length of each base unit in a transverse direction.

The lower horizontal frame may be a square pipe or C-beam, which is a plurality of frames arranged and fixed between lower ends of the vertical frames, or which is a single frame coupled and fixed to the lower ends of the vertical frames.

The vertical frame is a square pipe or C-beam steel, which is a single frame that determines a length of each base unit in a transverse direction.

The vertical frame may be a square pipe or C-beam steel, which is a single frame that determines a length of each base unit in a transverse direction.

The fixing bracket may be a bent body in the shape of '⊓', where one end surface is welded or bolted to one side of the upper horizontal frame.

The fixing bracket of the present disclosure may be manufactured by extrusion at the same time as the upper horizontal frame.

The support bracket provided on the exterior wall frame of the building, where the fixing bracket is placed is, may include: a first bracket in the shape of '⊢' with a pair of through-holes formed in a width direction on an upper surface of the support bracket, the first bracket fixed to a surface of the external wall frame; and a second bracket in the shape of '⌋' with a pair of elongated holes formed in a width direction on a lower surface of the support bracket, the second bracket bolted to the first bracket.

A method for constructing a transverse-type building exterior block of the present disclosure includes: a base unit manufacturing step of manufacturing a base unit by manufacturing an assembly of upper and lower horizontal frames and a plurality of vertical frames arranged in parallel, while fixing a '⊓'-shaped fixing bracket to the upper horizontal frame, the bracket through which bolts vertically penetrate at an interval; an exterior panel manufacturing step of manufacturing an exterior panel which matches a size of each base unit; an individual component transportation step of transporting the factory-manufactured semi-units and exterior panels to a site using a vehicle; a semi-unit manufacturing step of manufacturing a semi-unit by vertically arranging and combining the manufactured base units; a main unit manufacturing step of manufacturing a main unit by combining a plurality of semi-units; a block completion step of completing a block by attaching the transported exterior panels to one entire side of the main unit; and an exterior wall installation step of transporting and lifting the completed block to an external wall frame of a building, placing the fixing bracket onto a '⊢'-shaped support brackets of the external wall frame, and securing the fixing bracket with a bolt.

A method for constructing a transverse-type building exterior block of the present disclosure includes: a base unit manufacturing step of manufacturing a base unit by manufacturing an assembly of upper and lower horizontal frames and a plurality of vertical frames arranged in parallel, while fixing a '⊓'-shaped fixing bracket to the upper horizontal frame, the bracket through which bolts vertically penetrate at an interval; an exterior panel manufacturing step of manufacturing an exterior panel which matches a size of each base unit; an individual component transportation step of transporting the factory-manufactured semi-units and exterior panels to a site using a vehicle; a semi-unit manufacturing step of manufacturing a semi-unit by vertically arranging and combining the manufactured base units; a main unit manufacturing step of manufacturing a main unit by combining a plurality of semi-units; a block completion step of completing a block by attaching the transported exterior panels to one entire side of the main unit; and an exterior wall installation step of transporting and lifting the completed block to an external wall frame of a building and fixing the block by welding or bolt tightening.

In the base unit manufacturing step, the vertical frames may be arranged at intervals along a longitudinal of the upper horizontal frame, lower horizontal frames may be arranged between the lower ends of the arranged vertical frames and welded or bolted to form a frame unit, wherein a fixing bracket is installed on one side of the upper horizontal frame to be oriented perpendicularly to the vertical frames, and wherein a height adjustment bolts vertically penetrate and is fixed at midpoints on both sides of the center along the entire length of the lower horizontal frames.

The semi-unit manufacturing step may be a step of vertically arranging manufactured base units and welding or bolting the vertically arranged base units to manufacture a frame unit.

The exterior wall installation step may be a step of manufacturing a panel in a size that fits an outer frame of the base unit, and the panel may be a panel for forming an exterior wall, including a metal panel or a sandwich panel.

The individual component transportation step may be a step of loading the manufactured semi-units and exterior panels into a vehicle and transporting the same to a field yard or assembly site.

In the main unit manufacturing step, a pair of transported semi-units may be arranged on both sides about a vertical axis and then welded or bolted to manufacture a single main unit to be installed.

In the block completion step, the exterior panels may be coupled to one side of base units forming a main unit and then bolted to the entire main unit.

In the exterior wall installation step, the completed block may be transported and lifted to the exterior wall frame of the main building and a bent end of the fixing bracket may be placed on a '⊢'-shaped support bracket pre-installed on the exterior wall frame and is then fastened by bolt tightening.

Advantageous Effects

According to the present disclosure, a base unit or a semi-unit 20, which is an assembly of the base units, may be first manufactured in a manufacturing factory, and then an exterior panel sized to fit the base units or the semi-unit may be manufactured and transported to a construction site, and through a simple assembly process, the base units may be arranged and combined into a semi-unit, which is then combined with one another into a main unit; alternatively, the semi-units may be assembled into the main unit, and then the exterior panel may be attached to the manufactured main unit to complete a block, and such completed blocks may be then transported to an exterior wall frame of a building and sequentially stacked and assembled, thereby allowing the production of standardized blocks and enhancing the manufacturability and on-site constructability of each component and block.

According to the present disclosure, in a state where a horizontal lower surface of a second bracket in the shape of '⊥' is placed on a horizontal upper surface of a first bracket in the shape of '⊓', bolts may pass through through-holes of the first bracket and elongated holes of the second bracket and then a protruding length of the second bracket relative to the first bracket may be adjusted by tightening with nuts, and therefore, the flatness of the installed blocks can be controlled by adjusting the horizontal position of the block.

According to the present disclosure, after the fixing bracket provided on the block is placed on the support bracket of the external wall frame of the building, a height may be adjusted and fixed by tightening the bolts, thereby enabling the rapid construction of a large block with significant area and weight.

According to the present disclosure, a height adjustment bolt is provided on the lower horizontal frame and placed correspondingly on the upper horizontal frame of another base unit to be coupled to the bottom of the lower horizontal frame, and by adjusting the height of the bolt placed in the above-described state, the height and tilt of the base units to be stacked can be adjusted to assemble and manufacture a straight semi-unit assembly.

According to the present disclosure, base units are manufactured in a factory and combined into a semi-unit, and the semi-units, along with exterior panels, are then transported to a construction site, and at the site, the exterior panels are combined with a main unit, which is formed by combining the semi-units, thereby reducing or eliminating the use of equipment, manpower, yards, etc. at the site, while making construction extremely easy and rapid.

According to the present disclosure, factory-manufactured base units and exterior panels are transported by vehicle, making the transport quick and easy regardless of the time of day, and at the site, the base units are combined into a semi-unit, which is then combined with one another into a main unit, and only the exterior panels are coupled to the main unit to complete a block for installation as the building's exterior wall, thereby reducing or eliminating the need for equipment, manpower, and storage yards on site, while ensuring that construction is carried out efficiently and rapidly.

BEST MODE FOR DISCLOSURE

Figure 1:
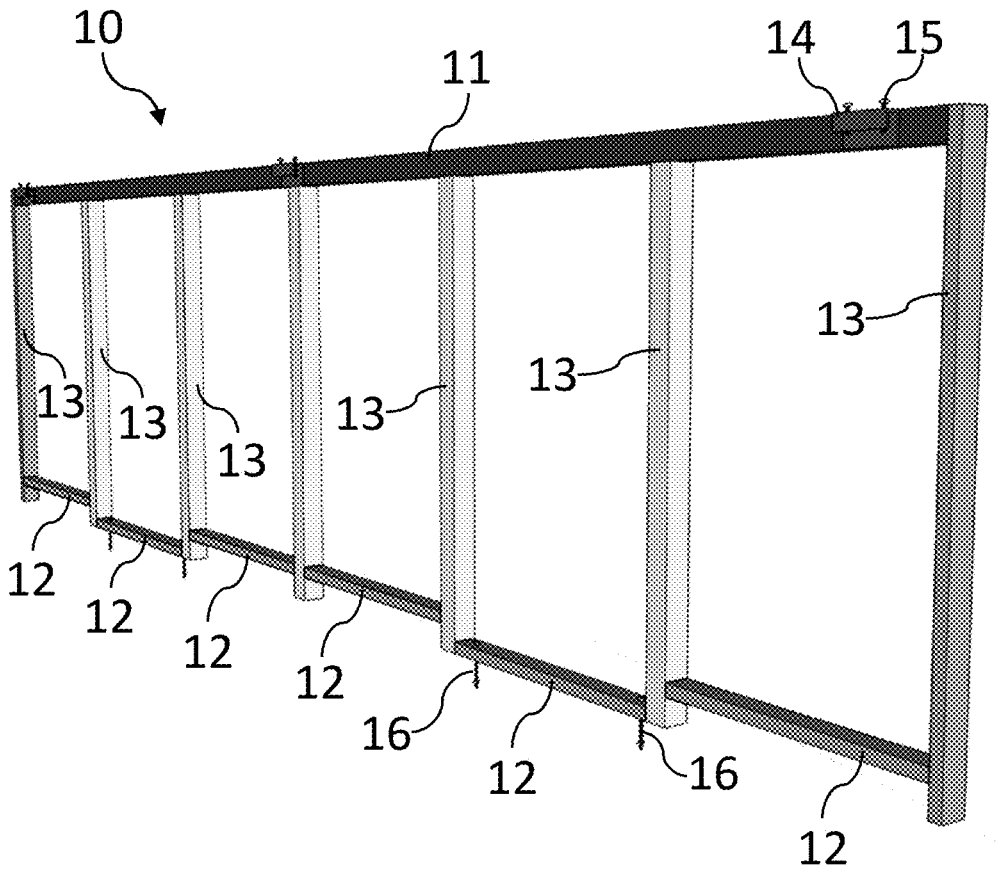
FIG. 1 is a perspective view illustrating the configuration of a base unit according to an embodiment of the transverse-type exterior panel of the present disclosure.

Hereinafter, embodiments disclosed herein will be described in detail with reference to the accompanying drawings, wherein identical or similar components will be assigned the same reference numerals regardless of drawing designation and duplicative descriptions will be omitted. Further, in describing the embodiments disclosed herein, specific descriptions of related prior art are omitted where it is determined that such detailed descriptions would obscure the essence of the embodiments disclosed herein.

Terms containing ordinal numbers, such as first, second, etc., may be used to describe various components, but the components are not limited by the terms. The above terms are used only for the purpose of distinguishing one component from another.

Singular expressions include plural expressions unless the context clearly dictates otherwise.

In this application, the described steps may be carried out in any sequence, except in cases where a clearly defined cause-and-effect relationship necessitates a specific order.

It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Hereinafter, the present disclosure will be described with reference to the accompanying drawings.

Figure 2:
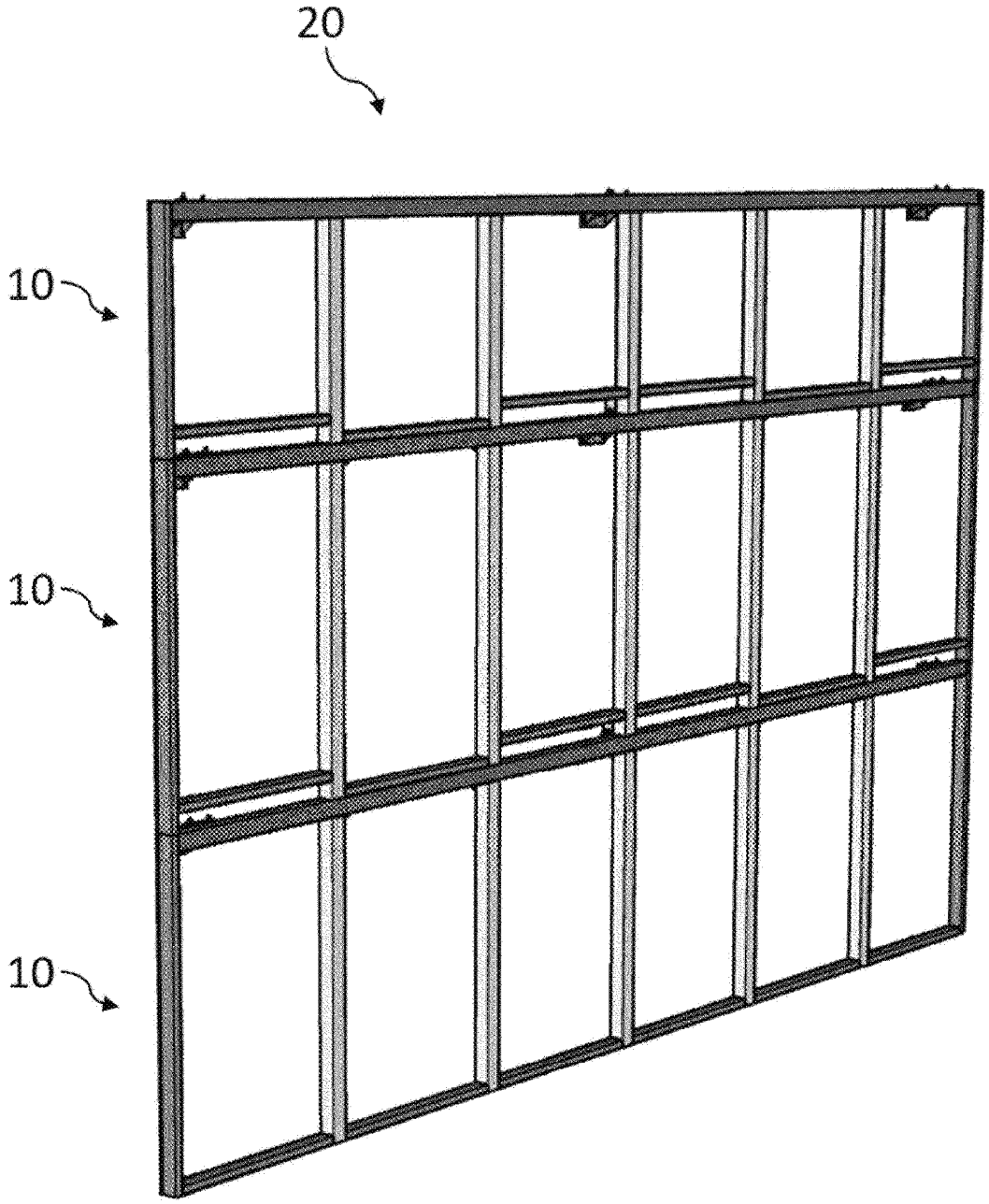
FIG. 2 is a perspective view showing an example of a semi-unit combination of base units according to an embodiment of the transverse-type exterior panel of the present disclosure.
Figure 3:
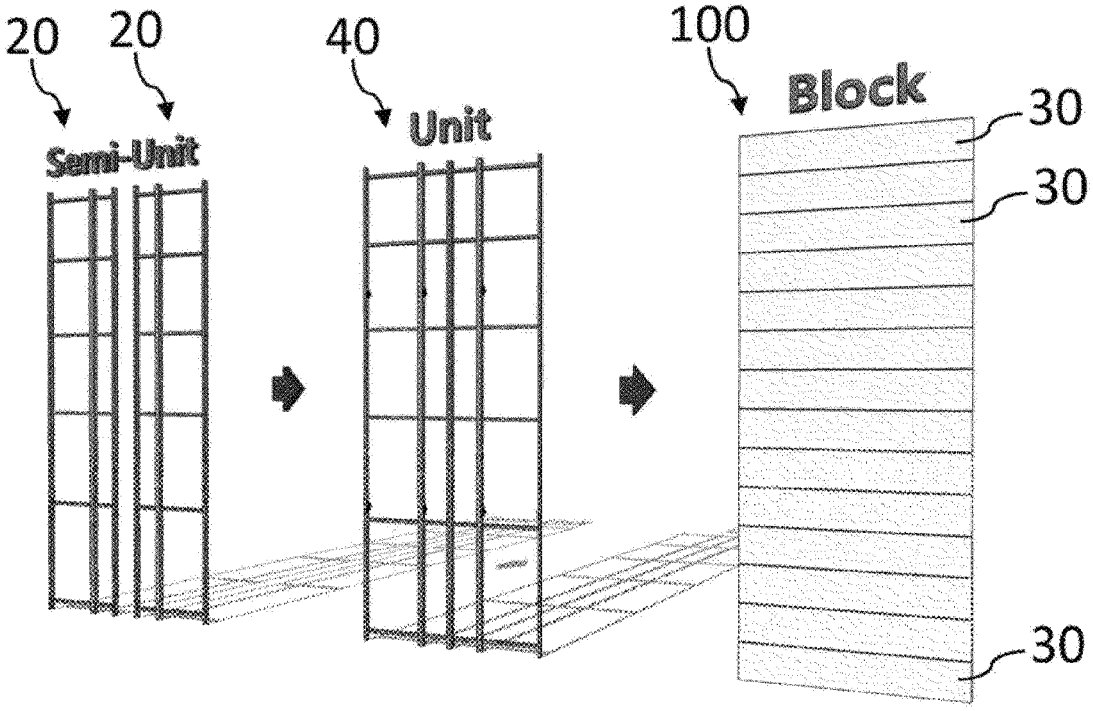
FIG. 3 is a perspective view briefly showing an example in which a semi-unit according to an embodiment of the transverse-type exterior panel of the present disclosure is manufactured as a main unit and exterior panels are coupled to the main unit.

First, as shown in FIGS. 1 to 3 of the accompanying drawings, a transverse-type building exterior block 100 of the present disclosure may include a base unit 10 configured as an assembly of a plurality of vertical frames 13 arranged side by side between an upper horizontal frame 11 and a lower horizontal frame 12, the base unit 10 having a fixing bracket 14 in the shape of '⊓' fixed to the upper horizontal frame 11, through which vertical bolts penetrate at an interval; a semi-unit 20 formed by arranging the base units 10 in a vertical direction and coupling and fixing the vertically arranged base units 10 to one another; a main unit 40 formed by arranging the semi-units 20 in a horizontal direction and coupling and fixing the horizontally arranged semi-units 20 to one another; and an exterior panel 30 covered and secured to one side of the main unit 40.

In the present disclosure, the base unit 10 or the semi-unit 20, which is an assembly of the base units 10, may be first manufactured in a manufacturing factory, and then an exterior panel 30 sized to fit the base units 10 or the semi-unit 20 may be manufactured and transported to a construction site, and through a simple assembly process, the base units 10 may be arranged and combined to form a semi-unit 20, which is then combined with one another into the main units 40; alternatively, the semi-units 20 may be assembled into the main unit 40, and then the exterior panel 30 may be attached to the manufactured main unit 40 to complete the block 100, and such completed blocks 100 may be then transported to an exterior wall frame 200 of a building and sequentially stacked and assembled, thus reducing or minimizing the use of equipment, labor, and storage yards, and enabling rapid construction.

In addition, the present disclosure not only allows for the production and construction of standardized blocks 100, but also improves the manufacturability and on-site constructability of each component and block 100.

BEST MODE FOR DISCLOSURE

Here, in the present disclosure, a base unit 10 may include: an upper horizontal frame 11; a plurality of vertical frames 13 arranged and fixed at intervals along a longitudinal direction of the upper horizontal frame 11; a lower horizontal frame 12 arranged and fixed at lower ends of the vertical frames 13; a fixing bracket 14 in the shape of '⊓', which is provided perpendicularly to the vertical frames 13 on one side of the upper horizontal frame 11, and which is seated on a support bracket 210 in the shape of '⌐' provided on an exterior wall frame 200 of a main building on-site; a pair of adjustment bolts 15 vertically penetrating from an upper surface of the fixing bracket 14 to a lower surface of the exterior wall frame 210 to be secured and adjust a height by nut tightening; and a height adjustment bolt 16 vertically penetrating and fixed to the lower horizontal frame 12 at midpoints on both sides of the center along the entire length of the lower horizontal frames 12.

The upper horizontal frame 11 of the present disclosure may be a square pipe or C-beam steel, and may be a single frame that determines the length of the base unit 10 in a transverse direction.

In addition, the lower horizontal frame 11 of the present disclosure may be a square pipe or C-beam steel, and may a plurality of frames arranged and coupled between the lower ends of the vertical frames 13 and secured together.

In addition, the lower horizontal frame 12 of the present disclosure may be a square pipe or C-beam steel, and may be a single frame coupled and fixed to the lower ends of the vertical frames 13.

In addition, the vertical frames 13 of the present disclosure may be square pipes and may be frames that determine a longitudinal height of the base unit 10.

In addition, the fixing bracket 14 of the present disclosure may be a bent body in the shape of '⊓', where one end surface may be welded or bolted to one side of the upper horizontal frame 11.

In addition, the fixing bracket 14 of the present disclosure may be extruded at the same time as the upper horizontal frame 11.

In the present disclosure, in a state where the fixing bracket 14 is placed on the support bracket 210 of the exterior wall frame 200 of the main building, the bolt 15 may pass through and tightened with a nut to adjust the height.

At this point, it is preferable that one nut is coupled between the fixing bracket 14 and the support bracket 210 and another nut is coupled to a lower surface of the support bracket 210.

The nut coupled between the fixing bracket 14 and the support bracket 210 serves to adjust the height and maintain the adjusted height, and the nut coupled to the lower surface of the support bracket 210 is tightened to fix the fixing bracket 14 to the support bracket 210.

At this point, it is also preferable that a coil spring is provided between the fixing bracket 14 and the support racket 210 so that the coupled state of the bolt 15 is firmly maintained by the expansion pressure of the spring.

In addition, the support bracket 210 provided on the external wall frame 200 of the building, where the fixing bracket 14 is placed, may include: a first bracket 211 which is in the shape of '⌈' with a pair of through-holes 211*a* formed in a width direction on an upper surface of the support bracket 210, and which is fixed to a surface of the external wall frame 200; and a second bracket 212 which is in the shape of '⌋' with a pair of elongated holes 212*a* formed in a width direction on a lower surface of the support bracket 210, and which is bolted to the first bracket 211.

According to the present disclosure, in a state where the horizontal lower surface of the second bracket 212 in the shape of '⌋' is placed on the horizontal upper surface of the first bracket 211 in the shape of '⌈', bolts may pass through the through-holes 211*a* of the first bracket 211 and the elongated holes 212*a* of the second bracket 212 and then the protruding length of the second bracket 212 relative to the first bracket 211 may be adjusted by tightening with nuts, so that the flatness of the installed blocks 100 can be controlled by adjusting the horizontal position of the block 100.

According to the present disclosure as described above, after the fixing bracket 14 provided on the block 100 is placed on the support bracket 210 of the external wall frame 200 of the building, the height may be adjusted and fixed by tightening the bolts 15, thereby enabling the rapid construction of a large block 100 with significant area and weight.

In addition, the height adjustment bolt 16 of the present disclosure is provided on the lower horizontal frame 12 and placed correspondingly on the upper horizontal frame 11 of another base unit 10 to be coupled to the bottom of the lower horizontal frame, and by adjusting the height of the bolt placed in the above-described state, the height and tilt of the base units 10 to be stacked may be adjusted to assemble and manufacture a straight semi-unit 20 assembly.

Figure 4:
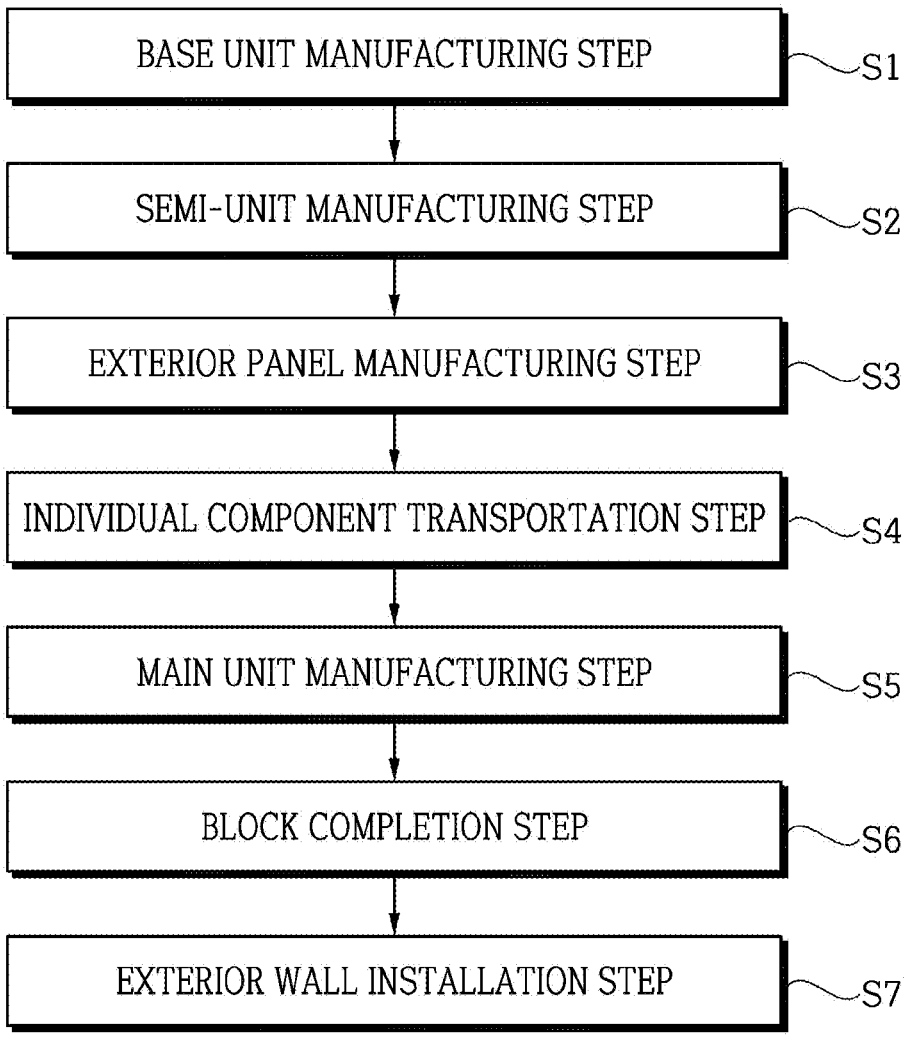
FIG. 4 is a block diagram showing steps according to an embodiment of a method for constructing a transverse-type exterior panel of the present disclosure.

Next, in one embodiment of the transverse-type exterior block constructing method of the present disclosure, as shown in the FIG. 4, the method may include the steps of: a base unit manufacturing step S1 of manufacturing a base unit 10 by manufacturing an assembly of upper and lower horizontal frames 11 and 12 and a plurality of vertical frames 13 arranged in parallel, while fixing a '⊓'-shaped fixing bracket 14 to the upper horizontal frame 11, the bracket 14 through which bolts 15 vertically penetrate at an interval; a semi-unit manufacturing step S2 of manufacturing a semi-unit 20 by vertically arranging and combining the manufactured base units 10; an exterior panel manufacturing step S3 of manufacturing an exterior panel 30 which matches a size of each base unit 10; an individual component transportation step S4 of transporting the factory-manufactured semi-units 20 and exterior panels 30 to a site using a vehicle; a main unit manufacturing step S5 of manufacturing a main unit 40 by combining a plurality of semi-units 20 transferred; a block completion step S6 of completing a block 100 by attaching the transported exterior panels 30 to one entire side of the main unit 40; and an exterior wall installation step S7 of transporting and lifting the completed block 100 to an external wall frame 200 of a building and fixing the block 100 by welding or bolt tightening.

According to the present disclosure, proceeding through these methodological steps, it is possible to manufacture the base units 10 and the semi-units 20, which are assemblies of the base units 10, in a production factory, and to pre-manufactured the exterior panels 30, each matching the size of each base unit 10 or each semi-unit 20, and transport them to a construction site, to make the semi-units 20 into a main unit 40 through a simplified assembly process, to attach the exterior panels 30 to the main unit 40 to complete a block 100, to transport the block 100 to the external wall frame 200 of the building, and sequentially stack and combine the blocks 100.

According to the present disclosure, the base units 10 are manufactured in a factory and combined into a semi-unit 20, and the semi-units 20, along with the exterior panels 30, are then transported to a construction site, and at the site, the exterior panels 30 are combined with the main unit 40, which is formed by combining the semi-units, thereby reducing or eliminating the use of equipment, manpower, yards, etc. at the site, while making construction extremely easy and rapid.

Figure 5:
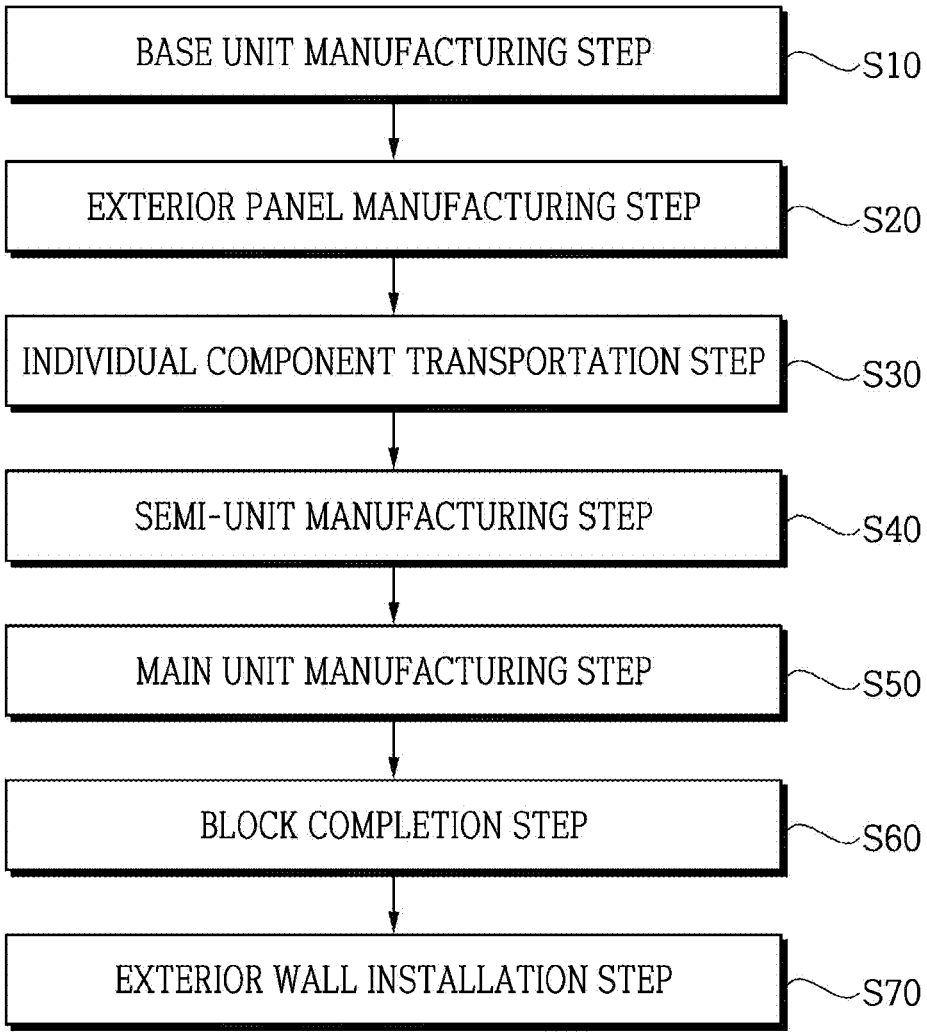
FIG. 5 is a sequence block diagram showing steps according to another embodiment of a method for constructing a transverse-type exterior panel of the present disclosure.
Figure 6:
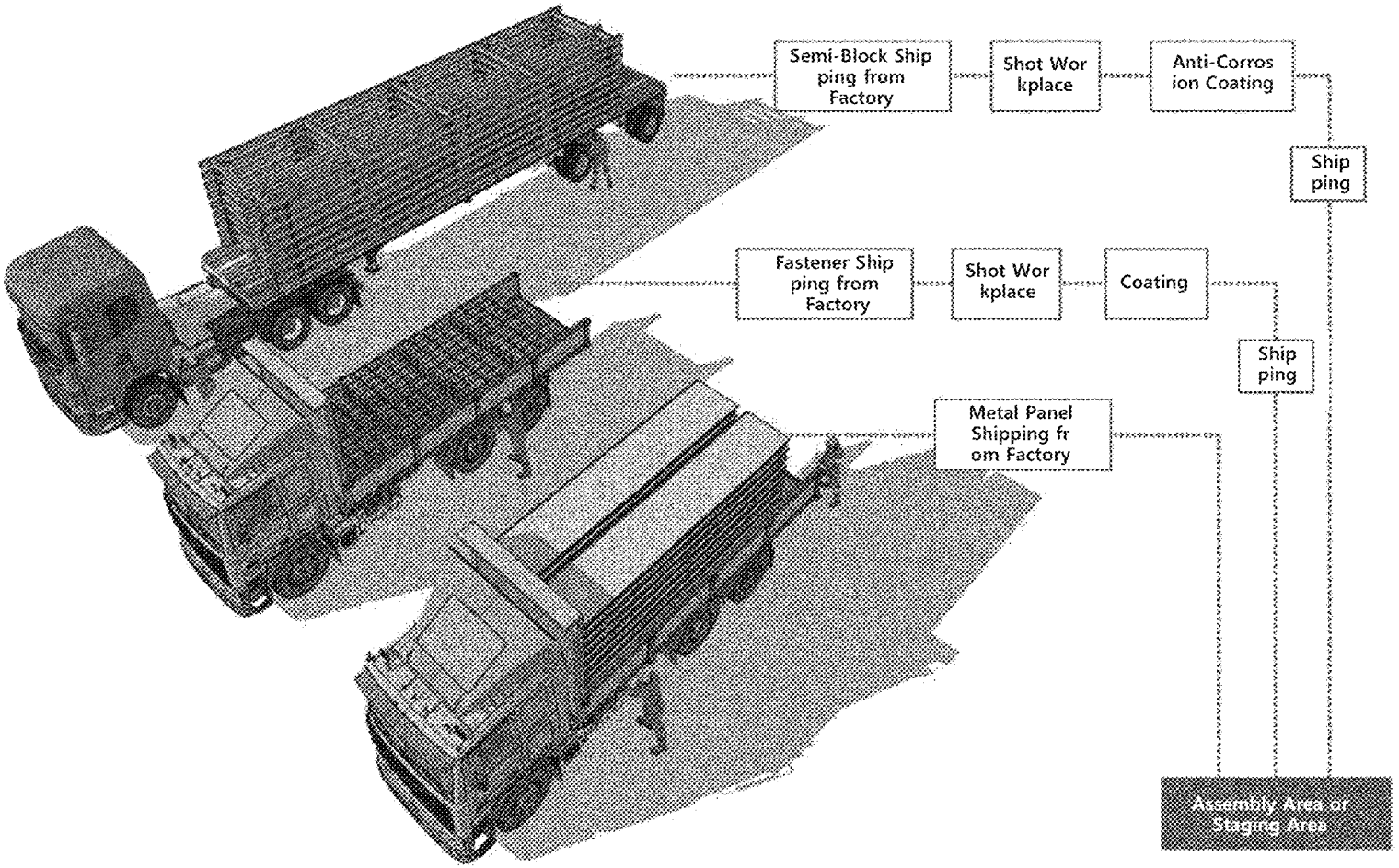
FIG. 6 is a perspective view showing an example of transporting each component in an individual component transportation step of the present disclosure.

Additionally, according to another embodiment of a method for constructing a transverse-type exterior block of the present disclosure, as shown in FIG. 5, the method may include the steps of: a base unit manufacturing step S10 of manufacturing a base unit 10 by manufacturing an assembly of upper and lower horizontal frames 11 and 12 and multiple vertical frames 13 arranged in parallel, while fixing a '⊓'-shaped fixing bracket 14 to the upper horizontal frame 11, the bracket 14 through which bolts 15 vertically penetrate at an interval; an exterior panel manufacturing step S20 of manufacturing an exterior panel 30 that matches the size of each base unit 10; an individual component transportation step S30 of transporting the factory-manufactured base units 10 and exterior panels 30 to a site using a vehicle;

a semi-unit manufacturing step S40 of vertically arranging and combining the transported base units 10 on-site to fabricate a semi-unit 20; a main unit manufacturing step S50 of manufacturing a main unit 40 by combining a plurality of semi-units 20; a block completion step S60 of completing a block 100 by attaching the transported exterior panels 30 to one entire side of the main unit 40; and an exterior wall installation step S70 of transporting and lifting the completed block 100 to the external wall frame 200 of the building, placing the fixing bracket 14 onto the '┗'-shaped support bracket 210 of the external wall frame 200, and securing the fixing bracket 14 with a bolt 15.

According to the present disclosure, proceeding through these methodological steps, it is possible to manufacture the base units 10 in a factory, pre-manufactured exterior panels 30 that match the size of the base units 10, and transport both to a construction site, and at the site, the base units 10 are combined into a semi-unit 20 through a simplified process, the semi-unit 20 is then combined with one another into a main unit 40, and the exterior panels 30 are coupled to the main unit 40 to complete the blocks 100. The completed blocks 100 are then transported to the external wall frame 200 of the building, where they are sequentially stacked and combined.

According to the present disclosure, the factory-manufactured base units 10 and exterior panels 30 are transported by vehicle, making it possible to perform the transport quickly and easily regardless of time of day, and at a site, the base units 10 are combined into a semi-unit 20, which is then combined with one another into a main unit 40, and only the exterior panels 30 are coupled to the main unit 40 to complete the blocks 100 for installation as the building's exterior wall, thereby reducing or eliminating the need for equipment, manpower, and storage yards on site, while ensuring that construction is carried out efficiently and rapidly.

In addition, the present disclosure using the above method not only enables the manufacturing and construction of standardized blocks 100 but also enhances the manufacturability and field constructability of each component and each block 100.

Hereinafter, one embodiment and the other embodiments related to the method for constructing a transverse-type building exterior block of the present disclosure will be described together, as they only differ in whether the semi-unit manufacturing steps S2 and S40 are performed in the factory or on-site, and are otherwise substantially the same.

Additionally, it should be noted that the choice between transporting the semi-units 20, manufactured by combining the base units 10 in the factory, along with the exterior panels 30 to the construction site, or transporting only the base units 10 along with the exterior panels 30 to the construction site, depends on whether the size of the base units 10 manufactured in the factory allows for their transport by vehicle.

Here, in the base unit manufacturing step S1, the vertical frames 13 may be arranged at intervals along the longitudinal of the upper horizontal frame 11, and lower horizontal frames 12 may be arranged between the lower ends of the arranged vertical frames 13 and welded or bolted to form a frame unit, wherein a fixing bracket 14 may be installed on one side of the upper horizontal frame 11 to be oriented perpendicularly to the vertical frames 13 and the height adjustment bolts 16 may vertically penetrate and be fixed at midpoints on both sides of the center along the entire length of the lower horizontal frames 12.

In the base unit manufacturing step S1 being carried out in a factory, which is a production place, respective pipes are manufactured into the upper horizontal frames 11, lower horizontal frames 12, and vertical frames 13 according to designed dimensions, the fixing bracket 14 and bolts 15 are attached at intervals to one side of the upper horizontal frame 11, and each frame is fixed by welding or bolting.

At this point, the manufactured base units 10 may be manufactured as units of various dimensions having the same horizontal width and different vertical heights, and the base units 10 of the same size or base units 10 of different sizes may be combined into a semi-unit 20.

Meanwhile, the semi-unit manufacturing step S2 of the present disclosure may be a step of vertically arranging the manufactured base units 10 and welding or bolting the manufactured base units 10 to manufacture a frame unit suitable for transportation.

In the semi-unit manufacturing step S2 being carried out in a manufacturing factory, the base units 10 are stacked and arranged vertically according to the designed dimensions and welded or bolted to manufacture a semi-unit 20.

Meanwhile, in the present disclosure, the exterior panel manufacturing step S3 is a step of manufacturing a panel in a size that fits an outer frame of the base unit 10, and the panel may be a panel for forming an exterior wall, including a metal panel or a sandwich panel.

In the exterior panel manufacturing step S3 is carried out in a factory, which is a production place, and is a step of manufacturing the exterior panels 30 so that one side of the base units 10 can be covered and made into a block according to the designed dimensions.

Meanwhile, in the present disclosure, the individual component transportation step S4 may be a step of loading the manufactured semi-units 20 and exterior panels 30 into a vehicle and transporting the same to a field yard or assembly site.

The individual component transportation step S4 is a step of loading and transporting the manufactured units, exterior panels 30, and other components by a vehicle having an appropriate loading capacity and size.

Meanwhile, the main unit manufacturing step S5 of the present disclosure may be a step in which a pair of transported semi-units 20 are arranged on both sides about a vertical axis, and then welded or bolted to manufacture a single main unit 40 to be installed.

The main unit manufacturing step S5 is carried out at a construction site where the main building is being constructed, and the semi-units 20 are arranged in a horizontal direction according to the designed dimensions and then welded or bolted to manufacture a main unit 40.

On the other hand, the block completion step S6 of the present disclosure may be a step in which the transported exterior panels 30 are coupled to one side of the base units 10 forming a main unit 40 and then bolted to the entire main unit 40.

Figure 7:
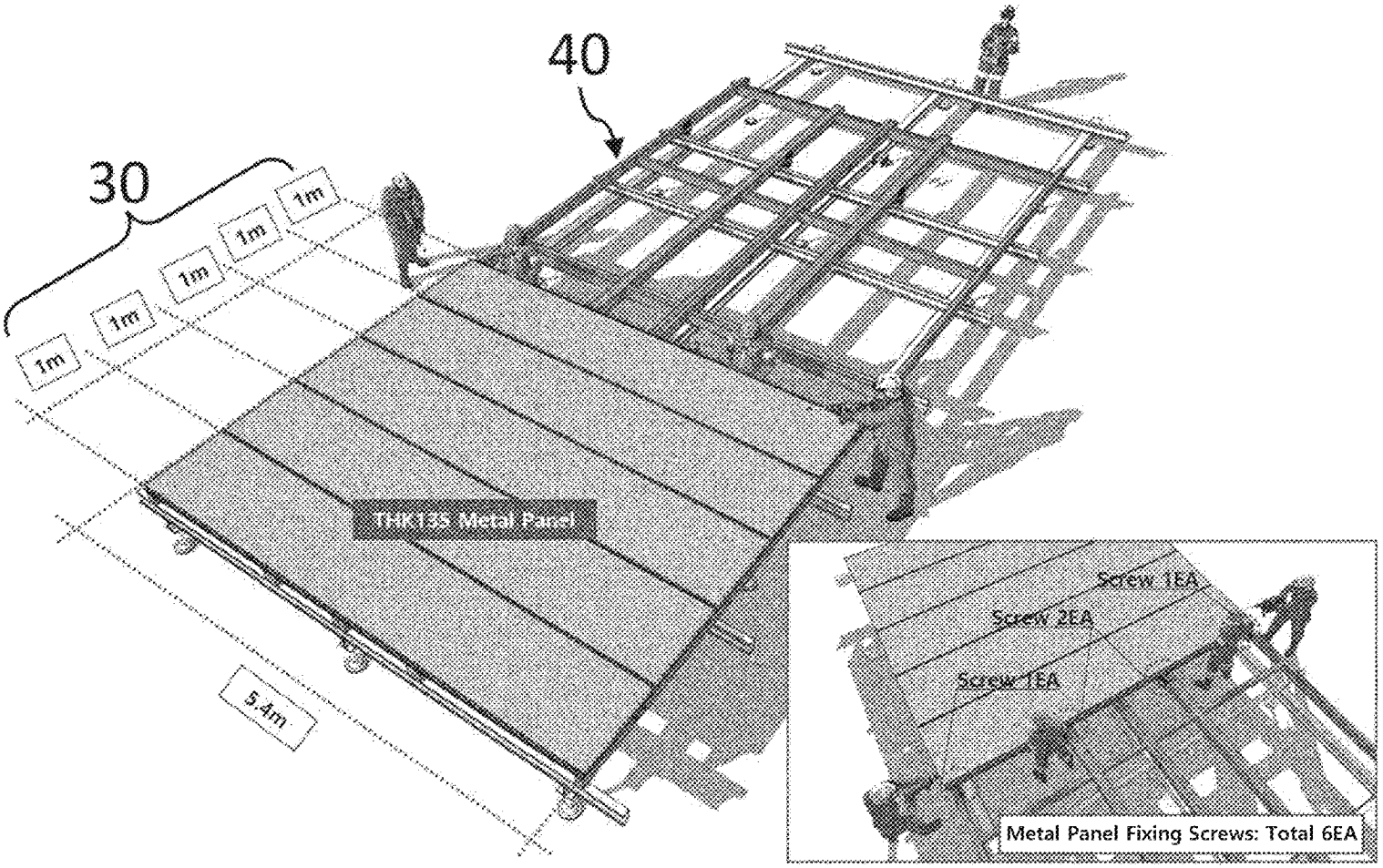
FIG. 7 is a perspective view showing an example of coupling exterior panels to a main unit in a block completion step of the present disclosure.

The block completion step S6 is carried out at the construction site where the main building is being constructed, as shown in FIG. 7, and the exterior panels 30 are sequentially arranged on the manufactured main unit 40 and welded or bolted to complete a block 100.

Meanwhile, the exterior wall installation step S7 of the present disclosure may be a step in which the completed block 100 is transported and lifted to the exterior wall frame 200 of the main building and then a bent end of the fixing bracket 14 is placed on the '┘'-shaped support bracket 210 pre-installed on the exterior wall frame 200 and fastened by bolt tightening.

Figure 8:
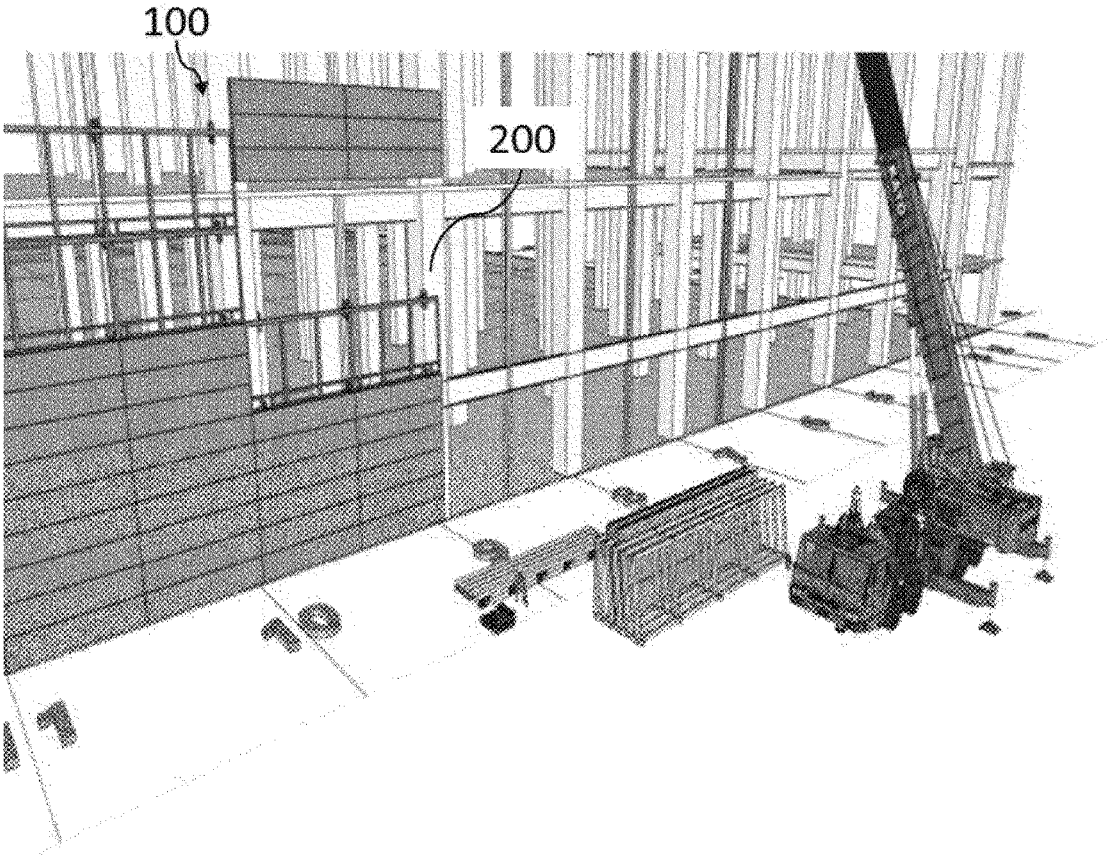
FIG. 8 is a perspective view showing an example in which blocks are transported using a tilting vehicle, lifted by a crane, and moved to an exterior wall frame of a building in an exterior wall installation step of the present disclosure.
Figure 9:
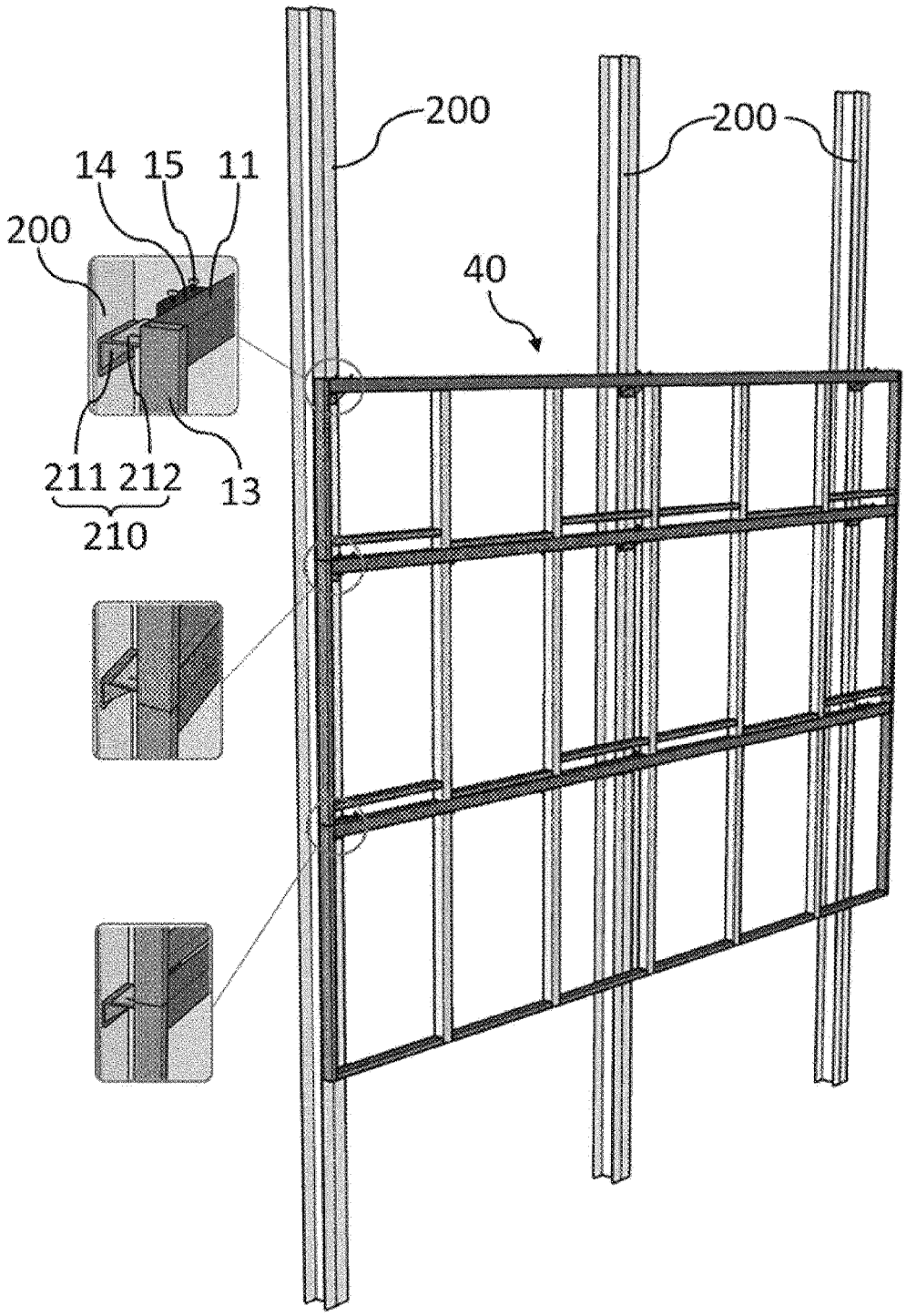
FIG. 9 is a perspective view showing an example (excluding exterior panels) in which a fixing bracket of a block is placed and fixed to a support bracket of an exterior wall frame of a building in an exterior wall installation step of the present disclosure.
Figure 10:
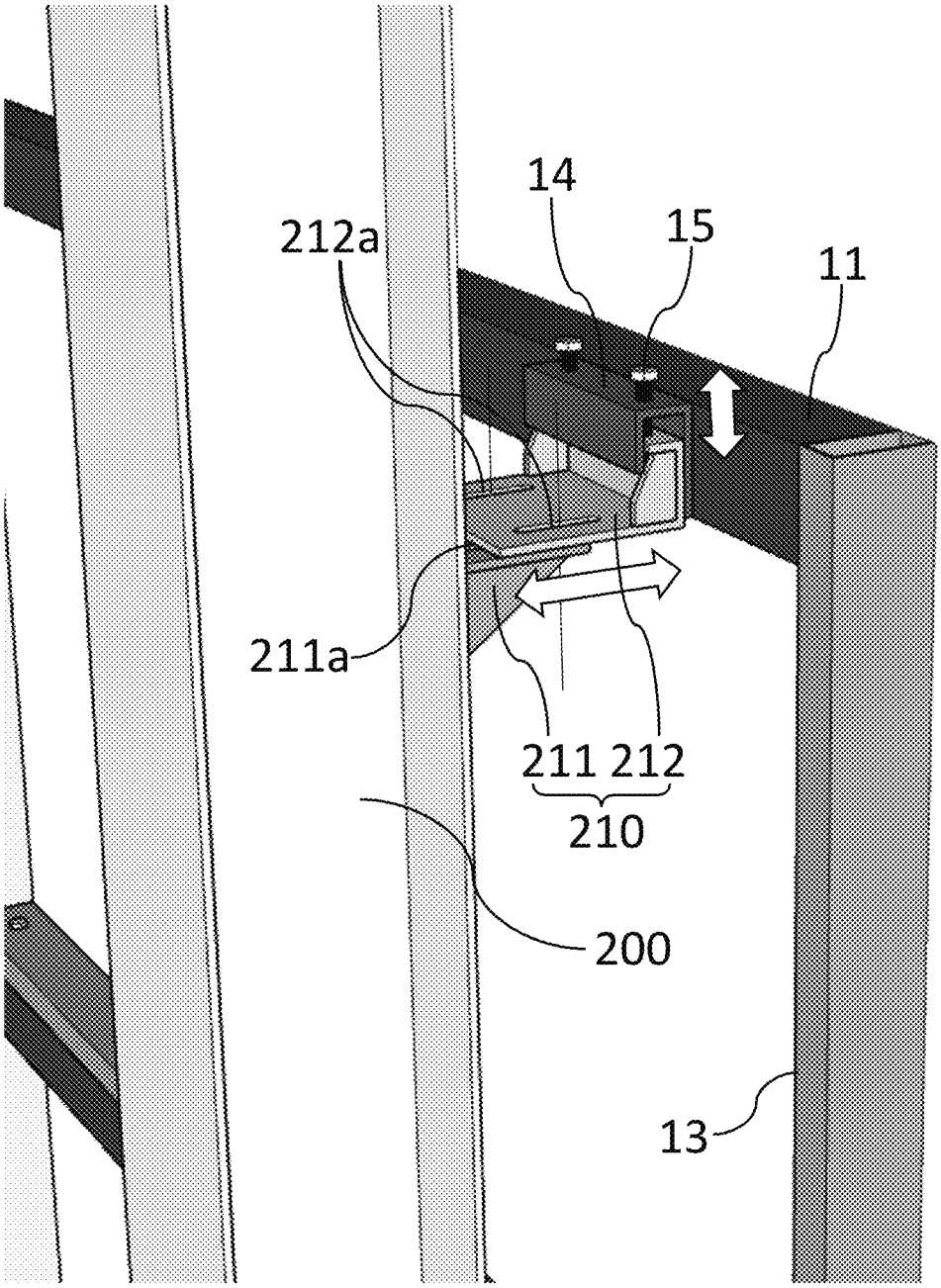
FIG. 10 is a perspective view of main parts clearly showing a state in which a fixing bracket is placed and fixed on a support bracket in the present disclosure.

In the exterior wall installation step S7, as shown in FIG. 8 of the attached drawing, the manufactured block 100 is lifted using a crane, rotated vertically, and moved toward the exterior wall frame 200 of the main building. As shown in FIG. 9, the fixing bracket 14 on the block 100 is placed on the support bracket 210 of the exterior wall frame 200 and secured by tightening the bolt 15, thereby achieving height adjustment and joint fixation, which enables the quick construction of a large block 100 with a large area and considerable weight.

At this point, as for the support bracket 210 of the exterior wall frame 200, in a state where the horizontal lower surface of the second bracket 212 in the shape of '┘' placed on the horizontal upper surface of the first bracket 211 in the shape of '┌', as shown in FIG. 1, bolts may pass through the through-hole 211*a* of the first bracket 211 and the elongated holes 212*a* of the second bracket 212 and then the protrusion length of the second bracket 212 may be adjusted with respect to the first bracket 211 and fixed by nut tightening, so that the installed blocks 100 can be adjusted by adjusting the horizontal position of the blocks 100.

The technical features disclosed in each embodiment of the present disclosure are not limited to that specific embodiment, and unless they are incompatible with each other, the technical features disclosed in each embodiment can be combined and applied to different embodiments.

Therefore, although each embodiment is described mainly focusing on each technical feature, the technical features can be combined and applied to each other, provided they are not incompatible with one another.

The present invention is not limited to the aforementioned embodiments and the attached drawings, and various modifications and variations are possible from the perspective of a person skilled in the art to which the invention pertains. Therefore, the scope of the present disclosure should be defined by the appended claims and also equivalents to which such claims are entitled.

The invention claimed is:

1. A transverse-type building exterior block comprising:

a main unit, the main unit including a plurality of semi-units horizontally arranged and coupled and fixed to one another, each semi-unit including a plurality of base units vertically arranged and coupled and fixed to one another; and an exterior panel attached to one entire side of the main unit so as to cover the one entire side of the main unit and be secured to the main unit, wherein each base unit comprises:

an upper horizontal frame;

a lower horizontal frame;

a plurality of vertical frames arranged side by side between the upper horizontal frame and the lower horizontal frame, the plurality of vertical frames being arranged at intervals along a longitudinal direction of the upper horizontal frame and coupled and fixed at upper ends thereof to the upper horizontal frame and coupled and fixed at lower ends thereof to the lower horizontal frame;

a fixing bracket in the shape of '⊓' provided on one side of the upper horizontal frame in a direction perpendicular to the plurality of vertical frames; and height adjustment bolts vertically penetrating and fixed to the lower horizontal frame at midpoints on both sides of a center along an entire length of the lower horizontal frame.

2. The transverse-type building exterior block of claim 1, further comprising:

a support bracket in the shape of '┘', and an exterior wall frame of a main building on-site, wherein the support bracket is provided on the exterior wall frame, wherein the fixing bracket in the shape of '⊓' is seated on the support bracket, and wherein a pair of adjustment bolts vertically penetrate the fixing bracket and are tightened with nuts to secure the fixing bracket to the support bracket and adjust a height of the transverse-type building exterior block.

3. The transverse-type building exterior block of claim 2, wherein the upper horizontal frame comprises a square pipe or C-shaped steel channel, and is a single frame that defines a length of each base unit in a transverse direction.

4. The transverse-type building exterior block of claim 2, wherein the lower horizontal frame is a square pipe or C-shaped steel channel, and is either (i) a plurality of frames arranged and fixed between lower ends of the vertical frames, or (ii) a single frame coupled and fixed to the lower ends of the vertical frames.

5. The transverse-type building exterior block of claim 2, wherein the vertical frames are square pipes and define a height of each base unit in a longitudinal direction.

6. The transverse-type building exterior block of claim 2, wherein one end surface of the fixing bracket is welded or bolted to one side of the upper horizontal frame.

7. The transverse-type building exterior block of claim 2, wherein the support bracket, provided on the exterior wall frame of the main building, where the fixing bracket is placed, comprises:

a first bracket in the shape of '┌' having a pair of through-holes formed in a width direction on an upper surface of the support bracket and fixed to a surface of the exterior wall frame; and a second bracket in the shape of '┘' having a pair of elongated holes formed in a width direction on a lower surface of the support bracket and bolted to the first bracket, and wherein, in a state where a horizontal lower surface of the second bracket is placed on a horizontal upper surface of the first bracket, bolts pass through the through-holes of the first bracket and the elongated holes of the second bracket and a protruding length of the second bracket relative to the first bracket is adjusted and fixed by tightening nuts on the bolts.

8. A method for constructing a transverse-type building exterior block, the method comprising:

a base unit manufacturing step of manufacturing a plurality of base units by assembling upper and lower horizontal frames and a plurality of vertical frames arranged in parallel, while fixing a '⊓'-shaped fixing bracket to each upper horizontal frame, the fixing bracket through which bolts vertically penetrate at an interval;

a semi-unit manufacturing step of manufacturing a plurality of semi-units by vertically arranging the manufactured base units and welding or bolting the vertically arranged base units to one another;

an exterior panel manufacturing step of manufacturing exterior panels which match a size of each base unit or each semi-unit;

an individual component transportation step of loading the manufactured semi-units and the exterior panels into a vehicle and transporting the semi-units and the exterior panels to a field yard or assembly site;

a main unit manufacturing step of manufacturing a main unit by arranging a plurality of the transported semi-units in a horizontal direction and welding or bolting the semi-units to one another;

a block completion step of completing a block by attaching the transported exterior panels to one entire side of the main unit so that the exterior panels cover the one entire side and securing the exterior panels to the main unit; and an exterior wall installation step of transporting and lifting the completed block to an exterior wall frame of a building, placing the fixing bracket of the block onto a '┌┘'-shaped support bracket of the exterior wall frame, and securing the fixing bracket by tightening nuts on a bolt.

9. A method for constructing a transverse-type building exterior block, the method comprising:

a base unit manufacturing step of manufacturing a plurality of base units by manufacturing an assembly of upper and lower horizontal frames and a plurality of vertical frames arranged in parallel, while fixing a '⊓'-shaped fixing bracket to each upper horizontal frame, the fixing bracket through which bolts vertically penetrate at an interval;

a semi-unit manufacturing step of manufacturing a plurality of semi-units by vertically arranging the manufactured base units and welding or bolting the vertically arranged base units to one another;

an exterior panel manufacturing step of manufacturing exterior panels which match a size of each base unit or each semi-unit;

an individual component transportation step of loading the manufactured semi-units and the exterior panels into a vehicle and transporting the semi-units and the exterior panels to a field yard or assembly site;

a main unit manufacturing step of manufacturing a main unit by arranging a plurality of the transported semi-units in a horizontal direction and welding or bolting the semi-units to one another;

a block completion step of completing a block by attaching the transported exterior panels to one entire side of the main unit so that the exterior panels cover the one entire side and securing the exterior panels to the main unit; and an exterior wall installation step of transporting and lifting the completed block to an external wall frame of a building and fixing the block to the exterior wall frame by welding or tightening bolts.

10. The method of claim 8, wherein, in the base unit manufacturing step, the vertical frames are arranged at intervals along a longitudinal direction of the upper horizontal frame, the lower horizontal frames are arranged between lower ends of the arranged vertical frames and welded or bolted thereto, the fixing bracket is installed on one side of the upper horizontal frame to be oriented perpendicularly to the vertical frames, and height adjustment bolts vertically penetrate and are fixed at positions corresponding to midpoints on both sides of a center along an entire length of the lower horizontal frames.

11. The method of claim 8, wherein, in the main unit manufacturing step, a pair of transported semi-units are arranged adjacent to each other in a horizontal direction and then welded or bolted to one another to manufacture a single main unit.

12. The method of claim 9, wherein, in the main unit manufacturing step, a pair of transported semi-units are arranged adjacent to each other in a horizontal direction and welded or bolted to one another to manufacture a single main unit.

13. The method of claim 9, wherein, in the exterior wall installation step, the completed block is transported and lifted to the exterior wall frame of a main building, a bent end of the fixing bracket is placed on a '┌┘'-shaped support bracket pre-installed on the exterior wall frame, and wherein the support bracket comprises:

a first bracket in the shape of '┌' having a pair of through-holes formed in a width direction on an upper surface of the support bracket and fixed to a surface of the external wall frame; and a second bracket in the shape of '┘' having a pair of elongated holes formed in a width direction on a lower surface of the support bracket and bolted to the first bracket, and wherein, in a state where a horizontal lower surface of the second bracket is placed on a horizontal upper surface of the first bracket, bolts pass through the through-holes of the first bracket and the elongated holes of the second bracket and a protruding length of the second bracket relative to the first bracket is adjusted and fixed by tightening nuts on the bolts.

* * * * *